US007629869B2

(12) United States Patent
Fujiyama

(10) Patent No.: US 7,629,869 B2
(45) Date of Patent: Dec. 8, 2009

(54) IGNITION COIL

(75) Inventor: Norihito Fujiyama, Obu (JP)

(73) Assignee: Denso Corporation, Kariya (JP)

( * ) Notice: Subject to any disclaimer, the term of this patent is extended or adjusted under 35 U.S.C. 154(b) by 369 days.

(21) Appl. No.: 11/826,270

(22) Filed: Jul. 13, 2007

(65) Prior Publication Data

US 2008/0024257 A1 Jan. 31, 2008

(30) Foreign Application Priority Data

Jul. 27, 2006 (JP) ..... 2006-205270

(51) Int. Cl.
*H01F 27/02* (2006.01)

(52) U.S. Cl. ..... 336/90

(58) Field of Classification Search ..... 336/65, 336/90, 96, 192, 198; 123/634–635
See application file for complete search history.

(56) References Cited

U.S. PATENT DOCUMENTS

| | | | | |
|---|---|---|---|---|
| 5,618,193 | A * | 4/1997 | Nakajima et al. | 439/125 |
| 6,622,712 | B2 * | 9/2003 | Nakashima et al. | 123/634 |
| 6,653,922 | B2 * | 11/2003 | Sano et al. | 336/96 |
| 6,977,572 | B2 * | 12/2005 | Kawai et al. | 336/90 |

FOREIGN PATENT DOCUMENTS

| | | |
|---|---|---|
| JP | 2000-138126 | 5/2000 |
| JP | 2004-022582 | 1/2004 |
| JP | 2004-111649 | 4/2004 |

OTHER PUBLICATIONS

Japanese Office Action dated Feb. 3, 2009, issued in corresponding Japanese Application No. 2006-205270, with English translation.

* cited by examiner

*Primary Examiner*—Tuyen Nguyen
(74) *Attorney, Agent, or Firm*—Nixon & Vanderhye, PC

(57) ABSTRACT

An ignition coil includes a coil body, a connector, a coil case, a filling resin, and a vent groove. The coil body includes a primary coil, a secondary coil, and a center core. The secondary coil has a secondary spool and a secondary wire wound around the spool. The center core is provided on an inner peripheral side of the secondary spool. The connector is coupled with an end of the coil body. The connector has an aligning part adapted for centering the center core. An end of the secondary spool has a tubular shape adapted for engagement with an outer periphery of the aligning part. The vent groove is provided to facing surfaces of the aligning part and of the end of the second spool. The vent groove is adapted for releasing gas around the center core to an exterior of the secondary spool.

8 Claims, 3 Drawing Sheets

IGNITION COIL

CROSS REFERENCE TO RELATED APPLICATION

This application is based on and incorporates herein by reference Japanese Patent Application No. 2006-205270 filed on Jul. 27, 2006.

BACKGROUND OF THE INVENTION

1. Field of the Invention

The present invention relates to an ignition coil used for generating a spark between a pair of electrodes in a spark plug in an internal combustion engine.

2. Description of Related Art

In an ignition coil used for an internal combustion engine, for example, a primary coil formed by winding a primary wire around a primary spool is disposed concentrically with a secondary coil formed by winding a secondary wire around a secondary spool so as to oppose with each other in a radial direction. A center core made of a magnetic material is disposed on an inner peripheral side of the primary and secondary coils, a peripheral core made of a magnetic material is disposed on the outside of the primary and secondary coils, and a magnetic circuit for generating a magnetic field passing through the center core and the peripheral core is formed.

Clearances in the ignition coil are filled with a filling resin, such as an epoxy resin, to fix and electrically insulate the components. The filling resin is filled in such a manner that the clearances in the ignition coil are evacuated to a vacuum state, and the filling resin in a liquid state is injected into the clearances in the vacuum state and hardened (cured).

However, when defect of the filling resin occurs in the ignition coil, an air gap due to the defect may generate a void (bubble). In a case, where the void moves to a peripheral portion, such as the primary coil or secondary coil, before the filling resin is set, the void may cause a crack or leakage of high-voltage current in the secondary coil. Consequently, various methods for eliminating the factors of checking the injection of the filling resin have been devised.

For example, in an ignition coil disclosed in JP-A-2004-22582, a void passage is provided to vertically penetrate through an upper elastic member, which is disposed above a rod-shaped center core made of a magnetic material, and which is inserted into the inner peripheral side of the primary and secondary coils. A connector, in which an igniter is disposed, is provided with a void passage communicated with the void passage in the upper elastic member. With the above configuration, at the time of charging the epoxy resin into the ignition coil, a void (bubble) existing in a clearance between the center core and an elastic tube covering the center core can be relatively easily released to the outside of the ignition coil via the void passage and the communicated void passage.

In JP-A-2004-22582, however, the communicated void passage has to be formed in a portion where the igniter is disposed in the connector. Thus, it is not easy to form the communicated void passage.

In the technique disclosed in JP-A-2004-22582, the connector has an aligning part for centering (aligning) the center core. In a case, where the aligning part is engaged with an end of the secondary spool on the low-voltage side thereof, it is difficult to sufficiently release a void. Specifically, in JP-A-2004-22582, since the void passage is formed in the upper elastic member, a void generated in the upper elastic member and a void generated in the center portion of the center core can be released. However, a void generated around the periphery of the center core may not be sufficiently released.

SUMMARY OF THE INVENTION

The present invention is made in view of the above disadvantages. Thus, it is an objective of the present invention to address at least one of the above disadvantages.

To achieve the objective of the present invention, there is provided an ignition coil, which includes a coil body, a connector, a coil case, a filling resin, and a vent groove. The coil body includes a primary coil, a secondary coil, and a center core made of a magnetic material. The center core is provided on an inner peripheral side of the primary coil and the secondary coil. The coil body has an end on a low-voltage side thereof. The secondary coil has a secondary spool made of a resin to have an annular cross section and a secondary wire wound around the secondary spool. The secondary coil is provided on an inner peripheral side of the primary coil. The center core is provided on an inner peripheral side of the secondary spool. The secondary spool has an end on a low-voltage side thereof. The connector is coupled with the end of the coil body on the low-voltage side thereof. The connector has an aligning part adapted for centering the center core. The aligning part has a tubular shape for supporting an end of the center core on a low-voltage side thereof. The end of the secondary spool has a tubular shape adapted for engagement with an outer periphery of the aligning part. The coil case receives the primary coil and the secondary coil. The filling resin is provided to fill clearance within the coil case and the connector. The vent groove is provided to facing surfaces of the aligning part and of the end of the second spool on the low-voltage side thereof. The vent groove is adapted for releasing gas around the center core to an exterior of the secondary spool.

To achieve the objective of the present invention, there is also provided an ignition coil, which includes a coil body, a connector, and a vent groove. The coil body includes a primary spool, a secondary spool, and a center core, all coaxially provided relative to each other. The center core is provided inside the primary spool and the secondary spool. The secondary spool has a tubular end toward a proximal end of the igniter coil. The connector is coupled with an end of the coil body toward the proximal end. The connector has an aligning part adapted for centering the center core. The aligning part has a tubular shape for supporting an end of the center core toward the proximal end. The aligning part has an outer peripheral surface that is engaged with an inner peripheral surface of the end of the secondary spool. The vent groove is provided to at least one of the outer peripheral surface of the aligning part and the inner peripheral surface of the end of the secondary spool.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE PREFERRED EMBODIMENTS

An embodiment of the ignition coil of the present invention will be described below with reference to the drawings.

Figure 1:
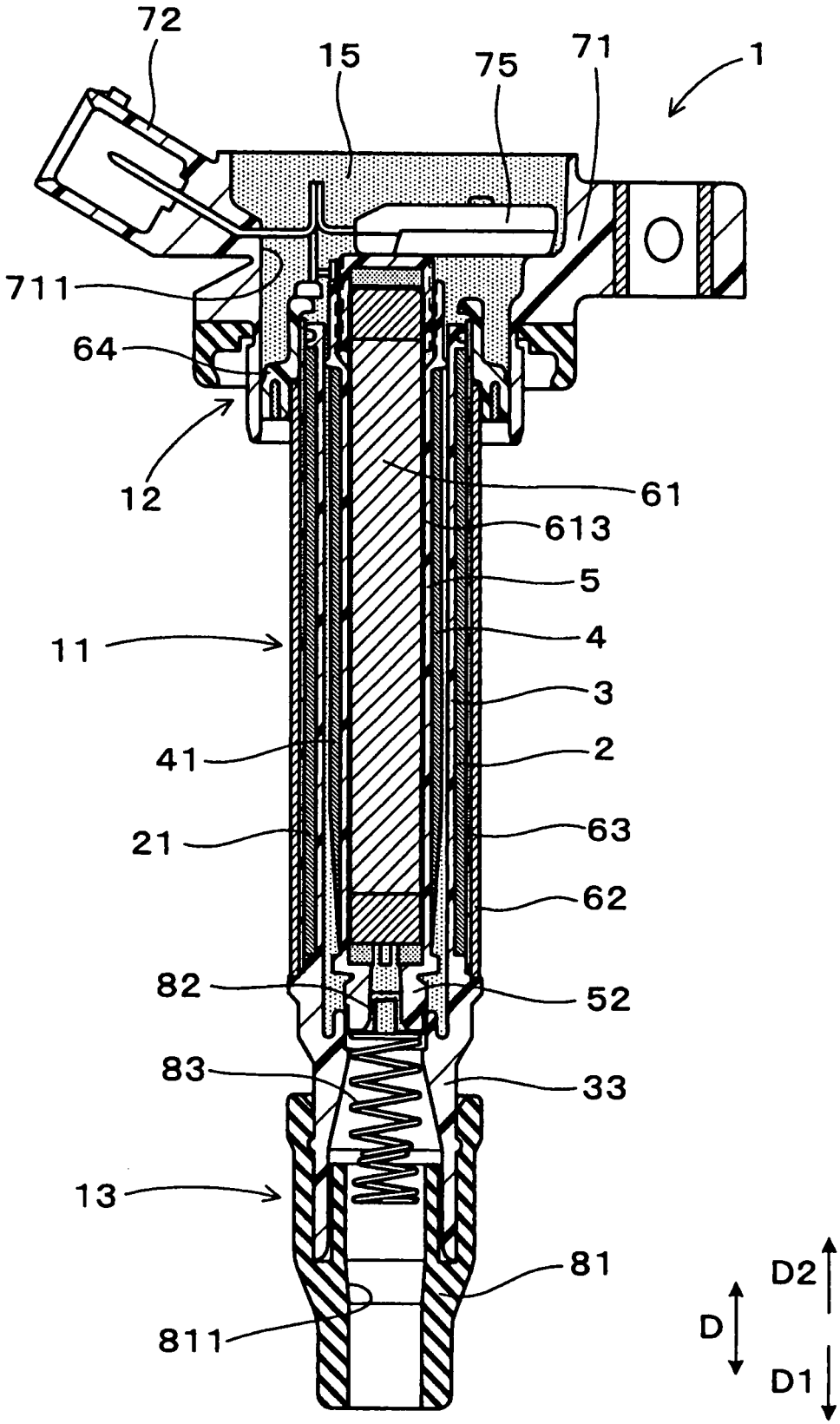
FIG. 1 is a cross sectional view illustrating an ignition coil in an embodiment.

As shown in FIG. 1, an ignition coil 1 of the embodiment has a coil body 11 and a connector 12. The coil body 11 has a rod-shaped center core 61, a primary coil 2, and a secondary coil 4, and the center core 61 is made of a magnetic material that is disposed on an inner periphery side of the primary coil 2 and the secondary coil 4. The connector 12 is coupled to an end of the coil body 11 on a low-voltage side thereof (an end of the coil body 11 in a direction D2). In the ignition coil 1, the primary coil 2 and the secondary coil 4 are housed in a coil case 63, and clearances in the coil case 63 and the connector 12 are filled with a filling resin 15 for fixing and electrically insulating the components.

Figure 2:
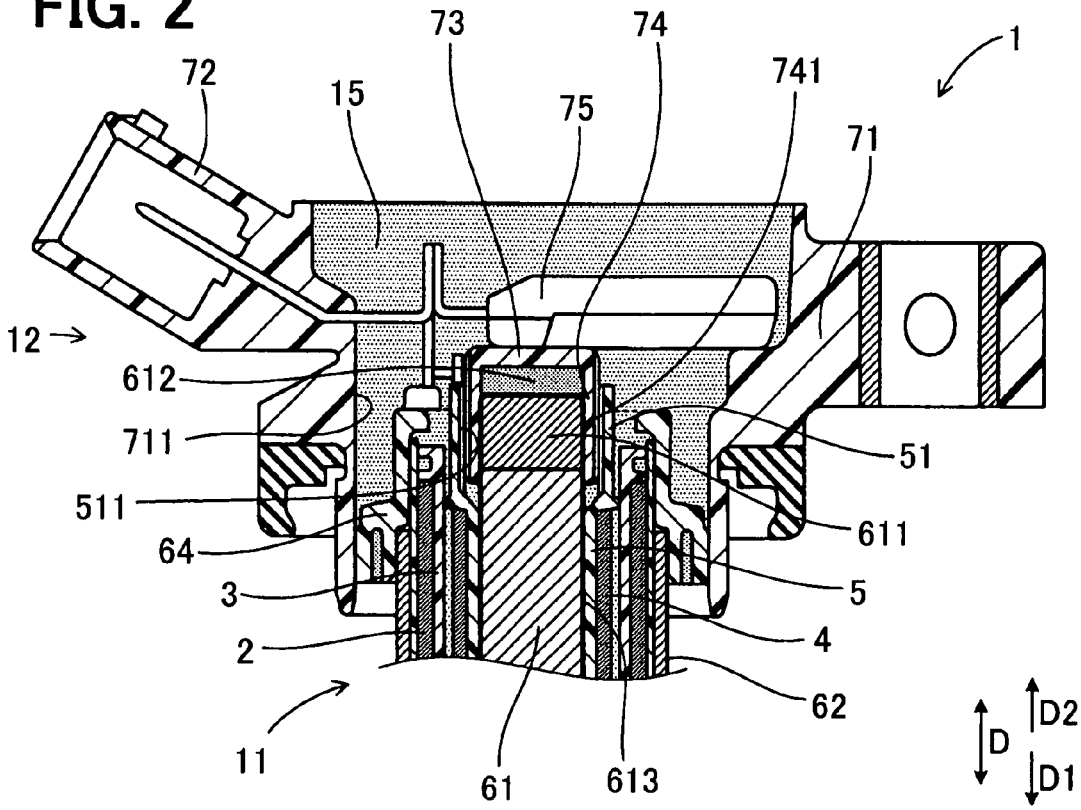
FIG. 2 is an enlarged cross sectional view of a periphery of a connector in the embodiment.
Figure 3:
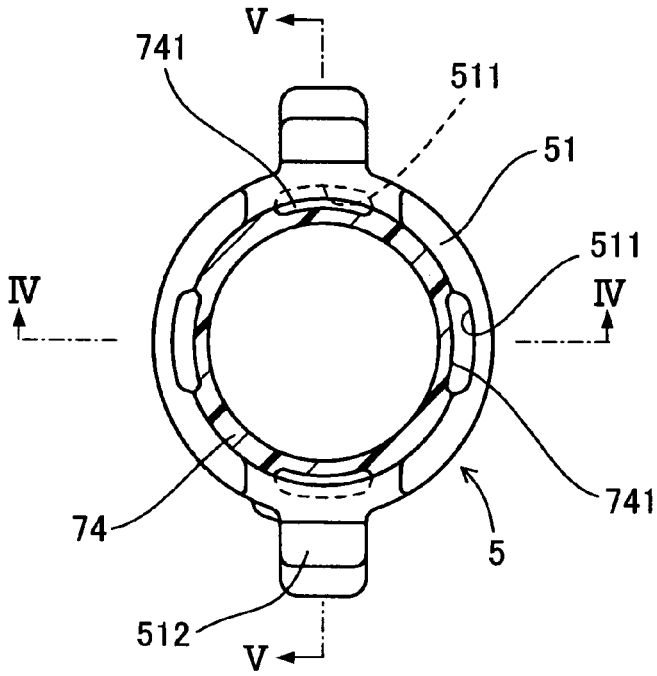
FIG. 3 is a plan view showing a state, where a low-voltage-side end of a secondary spool is engaged with an outer periphery of an aligning part in the embodiment.
Figure 4:
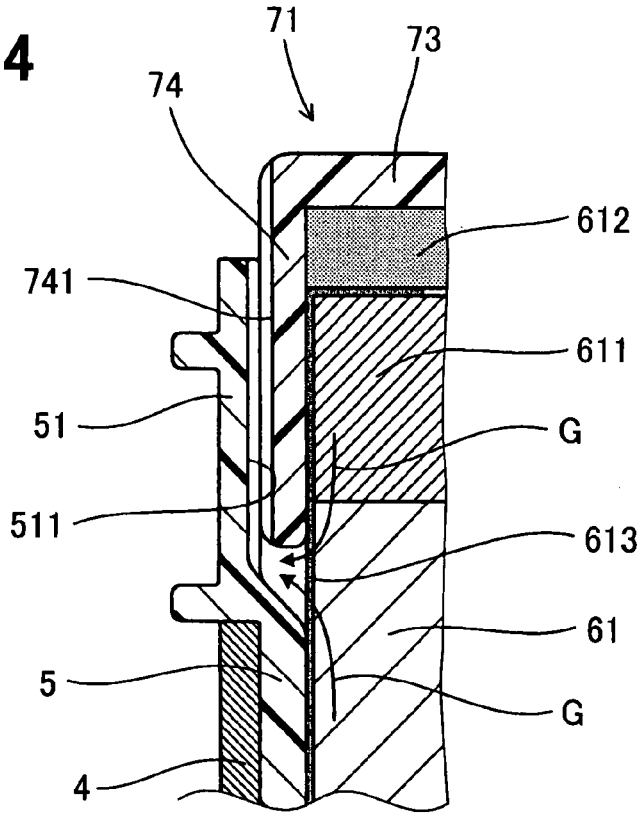
FIG. 4 is a cross sectional view taken along line IV-IV of FIG. 3 showing a state, where the low-voltage-side end of the secondary spool is engaged with the outer periphery of the aligning part in the embodiment.

As shown in FIGS. 2 to 4, the connector 12 is provided with an aligning part 74 for centering the center core 61 (e.g., for centering the center core 61 in the radial direction). The aligning part 74 has a cylindrical shape supporting an end of the center core 61 on the low-voltage side thereof (i.e., an end of the center core 61 in the direction D2 in FIG. 2). The secondary coil 4 is formed by winding an insulation-coated secondary wire 41 around a secondary spool 5 made of a resin and having an annular cross section. The secondary coil 4 is disposed on an inner periphery side of the primary coil 2, and the center core 61 is disposed on an inner periphery side of the secondary spool 5.

A low-voltage-side end 51 of the secondary spool 5 (an end 51 of the secondary spool 5 in the direction D2 in FIG. 2) has a hollow-cylindrical shape that fits around the aligning part 74. There are formed vent grooves 741, 511 for releasing gas G around the center core 61 to the outside of the secondary spool 5 at facing surfaces of the aligning part 74 and of the low-voltage-side end 51 of the secondary spool 5. Typically, the facing surface of the aligning part 74 faces with the facing surface of the low-voltage-side end 51 of the secondary spool 5.

The ignition coil 1 of the embodiment will be described in detail below with reference to FIGS. 1 to 5.

As shown in FIG. 1, the ignition coil 1 of the embodiment includes a plug attaching part 13, which is adapted for attaching a spark plug (not shown), on one end side (high voltage side) of the coil body 11 in an axial direction D1. Typically, the coil body 11 includes the coil case 63 that houses the primary coil 2 and the secondary coil 4 therein. Also, the ignition coil 1 includes the connector 12 on the other end side (low voltage side) of the coil body 11 in the axial direction D2. Typically, the connector 12 electrically connects the ignition coil 1 with an external electronic control unit (ECU) of an engine.

The ignition coil 1 of the embodiment is of a stick type, and is used in a state, where the coil body 11 and the plug attaching part 13 are disposed in a plug hole of the engine, and the connector 12 is disposed on the outside of the plug hole.

As shown in FIGS. 1 and 2, the connector 12 of the embodiment includes a connector case 71 and a connector coupling part 72, which are formed by integral molding with a thermoplastic resin. Typically, the connector case 71 has a fitting hole 711, into which the coil body 11 is fitted, and the connector coupling part 72 is formed so as to project radially outwardly of the connector case 71 for electrically connecting the ignition coil 1 with the exterior.

Figure 5:
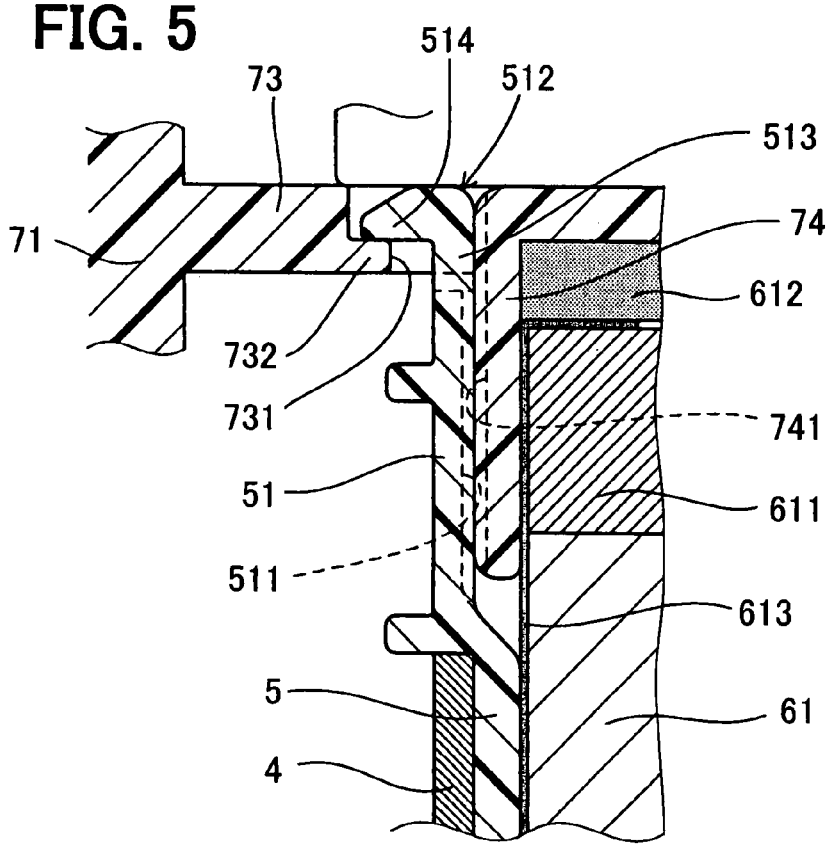
FIG. 5 is a cross sectional view taken along line V-V of FIG. 3 showing a state, where the low-voltage-side end of the secondary spool is engaged with the outer periphery of the aligning part in the embodiment.

As shown in FIG. 5, in the fitting hole 711 in the connector case 71, a bridge arm 73 is provided to the inner surface of the fitting hole 711. For example, one end of the bridge arm 73 is coupled with one part of the inner surface of the fitting hole 711, and the other end of the bridge arm 73 is coupled with another part of the inner surface of the fitting hole 711. The aligning part 74 is formed so as to project from the bridge arm 73 toward the high-voltage side of the ignition coil 1 (i.e., in the direction D1).

FIGS. 1, 2, and 4 are cross sectional views taken along line IV-IV of FIG. 3, and FIG. 5 is a cross sectional view taken along line V-V of FIG. 3.

As shown in FIG. 5, an engagement part 512 extends from the low-voltage-side end 51 of the secondary spool 5 such that the engagement part 512 enables the second spool 5 to be engaged with the bridge arm 73. The engagement part 512 has an extension part 513 extended in the axial direction of the secondary spool 5 and an engagement nail 514 projected outward in the radial direction from the extension part 513. The bridge arm 73 is provided with a through hole 731 and a retaining part 732. The through hole 731 receives the engagement nail 514, and the retaining part 732 is formed on the side face of the through hole 731 for retaining the engagement nail 514.

The secondary spool 5 can be stably (reliably) centered by making the engagement part 512 engage with the bridge arm 73.

As shown in FIG. 2, an igniter 75 for supplying power to a primary wire 21 in the primary coil 2 is disposed on the bridge arm 73 and on part of the connector case 71. A plurality of conduction pins in the igniter 75 is made conducted with a conduction pin, which is insert-molded in the connector coupling part 72.

The igniter 75 has a power supply circuit for supplying power to the primary wire 21, and has a current detection circuit for detecting an ion current flowing through the secondary wire 41 via a pair of electrodes in the spark plug.

The coil body 11 in the embodiment is fit (fitted) in the fitting hole 711 in the connector case 71 via an engagement member 64 made of a thermoplastic resin. The engagement member 64 has a hollow-cylindrical shape. An end of the primary spool 3 on the low-voltage-side thereof (an end of the primary spool 3 in the direction D2), and an end of an outer peripheral core 62, and an end of the coil case 63 are fit in the engagement member 64, and the outer peripheral side of the engagement member 64 is fit in the fitting hole 711.

As shown in FIGS. 3 to 5, the vent grooves 741, 511 of the embodiment are formed at the outer peripheral surface of the aligning part 74 and at the inner peripheral face of the low-voltage-side end 51 of the secondary spool 5, respectively. The vent grooves 741 at the outer peripheral surface of the aligning part 74 are formed to extend along a longitudinal axis D and are arranged at a plurality of positions in the circumferential direction of the aligning part 74. The vent grooves 511 at the inner peripheral surface in the low-voltage-side end 51 of the secondary spool 5 are formed to extend along the longitudinal axis D and are arranged at a plurality of positions in the circumferential direction of the end. For example, the vent grooves 741 extend in a longitudinal direction and are arranged in the circumferential direction on the outer peripheral surface of the aligning part 74. Also, the vent grooves 511 extend in the longitudinal direction and are arranged in the circumferential direction on the inner peripheral surface of the low-voltage-side end 51 of the secondary spool 5.

In the embodiment, the vent grooves 741 in the aligning part 74 are formed at four positions in the circumferential direction, and the vent grooves 511 in the low-voltage-side end 51 of the secondary spool 5 are formed at four positions in the circumferential direction.

As shown in FIG. 3, the vent grooves 741 in the outer peripheral surface of the aligning part 74 and the vent grooves 511 in the inner peripheral surface of the low-voltage-side end 51 of the secondary spool 5 are formed in circumferential positions to oppose to each other. For example, one of the vent grooves 741 is arranged at a position in the circumferential direction of the outer peripheral surface of the aligning part 74 to oppose to a corresponding one of the vent grooves 511, which is arranged at a position in the circumferential direction of the inner peripheral surface of the low-voltage-side end 51 of the secondary spool 5. Consequently, a vent passage having a larger cross sectional area can be formed by making the vent grooves 741 face the vent grooves 511.

The inner peripheral surface of the low-voltage-side end 51 of the secondary spool 5 faces the outer peripheral surface of the aligning part 74 when the secondary spool 5 is centered. Consequently, a clearance is hardly formed between the inner peripheral surface of the low-voltage-side end 51 and the outer peripheral surface of the aligning part 74.

In the embodiment, the clearance (the clearance of the vent passage) in the radial direction between the vent groove 741 and the vent groove 511 is formed in the size of about 0.95 mm. The clearance in the radial direction can be formed in the range of, for example, 0.5 mm to 1.5 mm to sufficiently release (discharge) gas G around the center core 61 in a state, where the thickness of the aligning part 74 and the thickness of the low-voltage-side end 51 are not excessively reduced.

In the embodiment, the width in the circumferential direction of the vent groove 741 and that of the vent groove 511 are set to be almost the same. However, the widths in the circumferential direction of them are not required to be always identical with each other. One of the vent grooves 741 and 511 may be formed wider than the other one. The vent grooves 511 and 741 may face each other in a state, where they are displaced relative each other in the circumferential direction.

As shown in FIGS. 2, 4, at the end of the center core 61 on the low-voltage side thereof (in the direction D2) of the embodiment, a permanent magnet 611 for limiting magnetic saturation in the center core 61 is coupled with a stress reduction member 612 for reducing stress acting along the longitudinal axis D of the center core 61 (i.e., in a magnetization direction). In the aligning part 74 formed in the connector 12, the stress reduction member 612 and the permanent magnet 611 are disposed. The aligning part 74 supports the end of the center core 61 on the low-voltage side thereof (i.e., the end of the center core 61 in the direction D2) in a state, where the aligning part 74 holds the stress reduction member 612 and the permanent magnet 611.

Around the center core 61, a stress reduction sheet 613 made of PET (polyethylene terephthalate) or the like is wound.

As shown in FIGS. 1, 2, the primary coil 2 is formed by winding the insulating-coated primary wire 21 around the primary spool 3 made of a resin and having an annular cross section. The secondary wire 41 of the secondary coil 4 has a diameter smaller than that of the primary wire 21 of the primary coil 2, and the secondary wire 41 is wound around the secondary spool 5 by the number of turns larger than that of the primary wire 21. The secondary wire 41 of the embodiment is wound at an angle. That is, the secondary wire 41 is wound at an angle in multiple layers in the direction D1 so that a diameter of each of the layers decreases in the direction D1.

On the outer peripheral side of the primary coil 2 and the secondary coil 4, the hollow-cylindrical-shaped outer peripheral core 62 made of a magnetic material is disposed. The center core 61 of the embodiment is formed by stacking (laminating) magnetic steel plates (e.g., silicon steel plates) in the radial direction of the ignition coil 1 so as to have a generally circular cross section. The outer peripheral core 62 of the embodiment is formed by laminating magnetic steel plates (e.g., silicon steel plates) in the radial direction, which are formed in a hollow-cylindrical shape corresponding to the shape of the outer peripheral surface of the coil case 63.

The coil case 63 has a thin hollow-cylindrical shape and is disposed between the outer peripheral surface of the primary coil 2 and the outer peripheral core 62.

As shown in FIG. 1, the plug attaching part 13 is formed by attaching a plug cap 81 made of rubber to a cap attaching part 33 extended from the end of the primary spool 3 on the high-voltage side thereof (i.e., the end of the primary spool 3 in the direction D1).

A high-voltage terminal (secondary terminal) 82 for connecting a high-voltage-side wire end of the secondary wire 41 is attached to a terminal attaching part 52 formed at the end of the secondary spool 5 on the high-voltage side thereof. A coil spring 83 for contacting a terminal of the spark plug (not shown) is attached in a conductive state to the high-voltage terminal 82. The high-voltage-side wire end of the secondary wire 41 is in conduction with the terminal of the spark plug via the high-voltage terminal 82 and the coil spring 83.

The high-voltage terminal 82 is provided between the terminal attaching part 52 in the secondary spool 5 and a holding part formed on the inner peripheral side of the cap attaching part 33 of the primary spool 3.

An insulation part in the spark plug (not shown) is fit in a hollow hole 811 formed in the plug cap 81, and a terminal formed at the tip of the insulation part is fixed to a cylinder head cover of the engine in a state, where the terminal is in contact with the coil spring 83.

As shown in FIG. 1, the clearances in the ignition coil 1 surrounded by the coil case 63, the connector 12, the primary spool 3, the high-voltage terminal 82, and the like are filled with the filling resin 15. The filling resin 15 in the embodiment is an epoxy resin.

In a process of forming the filling resin 15 in the ignition coil 1, after components of the ignition coil 1 have been assembled, the clearances in the ignition coil 1 are evacuated to a vacuum state. Then, the clearances in the vacuum state are filled with a liquid epoxy resin, and the liquid epoxy resin is hardened to form the filling resin 15.

In the ignition coil 1, when current is passed to the primary wire 21 initiated by a pulse-shaped signal from the ECU for generating the spark, a magnetic field passing through the center core 61 and the outer peripheral core 62 is generated. When the current passed to the primary wire 21 is stopped, an induction field passing through the center core 61 and the outer peripheral core 62 is generated in the direction opposite to the direction of the formation of the magnetic field. By the generation of the induction field, induced electromotive force (back electromotive force) of high voltage is generated in the secondary wire 41, and the spark can be generated between the pair of electrodes of the spark plug attached to the ignition coil 1.

The ignition coil 1 of the embodiment has an ion current detecting function. The ion current detecting function detects an ion current of ions, which are generated when ions generated by combustion in the engine, and which flow between the pair of electrodes in the spark plug. The ion current detecting function is provided by an ion current detecting circuit mounted on the igniter 75. The waveform of the ion current detected by the ion current detecting circuit is processed by an ion current detection processing circuit constructed in the ECU, and it is determined whether misfire occurs in the combustion of the engine or not.

The ignition coil 1 of the embodiment is devised to limit the generation of voids (bubbles) as unfilled air gaps around the center core 61 at the time of filling the space in the coil case 63 and the connector 12 of the ignition coil 1.

In the embodiment, the low-voltage-side end 51 of the secondary spool 5 is fit around the aligning part 74 to thereby center the center core 61 and the secondary coil 4 (centering in the radial direction). The vent grooves 741, 511 are provided to the facing surfaces of the aligning part 74 and of the low-voltage-side end 51 of the secondary spool 5 at multiple positions in the circumferential direction to oppose to each other. Consequently, it is easy to form the vent grooves 511 and 741, so that a venting structure for venting gas can be easily formed.

At the time of assembling the components (the primary coil 2, secondary coil 4, center core 61, coil case 63, connector 12, and the like) in the ignition coil 1 and filling the clearances in the coil case 63 and the connector 12 with the liquid filling resin 15, as shown in FIG. 4, the gas G existing around the center core 61 and the gas G existing in the stress reduction member 612 can be released to the outside of the secondary spool 5 via the vent grooves 511 and 741 such that the gas G is released to the outside of the ignition coil 1. The clearance in the secondary spool 5 can be filled with the liquid filling resin 15 via the vent grooves 511 and 741.

Thus, when the liquid filling resin 15 is hardened, the gases G existing around the center core 61 and the stress reduction member 612 can be limited from remaining in the secondary spool 5 and thereby limited from forming voids in the secondary spool 5.

Therefore, in the ignition coil 1 of the embodiment, the venting structure can be formed easily, and the generation of the voids in the filing resin 15 around the center core 61 can be effectively limited. Thus, the generation of cracks running from the voids as start points in the filing resin 15 can be effectively limited.

Additional advantages and modifications will readily occur to those skilled in the art. The invention in its broader terms is therefore not limited to the specific details, representative apparatus, and illustrative examples shown and described.

What is claimed is:

1. An ignition coil comprising:

a coil body that includes a primary coil, a secondary coil, and a center core made of a magnetic material, the center core being provided on an inner peripheral side of the primary coil and the secondary coil, the coil body having an end on a low-voltage side thereof, the secondary coil having a secondary spool made of a resin to have an annular cross section and a secondary wire wound around the secondary spool, the secondary coil being provided on an inner peripheral side of the primary coil, the center core being provided on an inner peripheral side of the secondary spool, the secondary spool having an end on a low-voltage side thereof;

a connector that is coupled with the end of the coil body on the low-voltage side thereof, the connector having an aligning part adapted for centering the center core, the aligning part having a tubular shape for supporting an end of the center core on a low-voltage side thereof, the end of the secondary spool having a tubular shape adapted for engagement with an outer periphery of the aligning part;

a coil case that receives the primary coil and the secondary coil;

a filling resin that is provided to fill clearance within the coil case and the connector; and a vent groove that is provided to facing surfaces of the aligning part and of the end of the second spool on the low-voltage side thereof, the vent groove being adapted for releasing gas around the center core to an exterior of the secondary spool.

2. The ignition coil according to claim 1, wherein the vent groove is one of a plurality of vent grooves that extend in a longitudinal direction and are arranged in a circumferential direction on at least one of an outer peripheral surface of the aligning part and an inner peripheral surface of the end of the secondary spool.

3. The ignition coil according to claim 2, wherein:

the at least one of the outer peripheral surface of the aligning part and the inner peripheral surface of the end of the secondary spool includes the outer peripheral surface of the aligning part and the inner peripheral surface of the end of the secondary spool; and each of the plurality of vent grooves is arranged in the circumferential direction of the outer peripheral surface of the aligning part to oppose to a corresponding one of the plurality of vent grooves, which is arranged in the circumferential direction of the inner peripheral surface of the end of the secondary spool.

4. The ignition coil according to claim 1, wherein the aligning part internally has a stress reduction member that is coupled with the end of the center core on the low-voltage side thereof, the stress reduction member being adapted for reducing a stress, which is applied in a longitudinal direction of the center-core.

5. The ignition coil according to claim 1, wherein:

the connector includes a connector case and a connector coupling part that is integral with the connector case, the connector case having a fitting hole, into which the coil body is fitted, the connector coupling part projecting radially outwardly of the connector case for electrically connecting with an exterior, and the connector includes an bridge arm that is provided to an inner peripheral surface of the connector case, the aligning part being provided to the bridge arm in the fitting hole.

6. The ignition coil according to claim 5, wherein:

the bridge arm has one end that is coupled with one part of the inner surface of the connector case; and the bridge arm has another end that is coupled with another part of the inner surface of the connector case.

7. An ignition coil comprising:

a coil body that includes a primary spool, a secondary spool, and a center core, all coaxially provided relative to each other, the center core being provided inside the primary spool and the secondary spool, the secondary spool having a tubular end toward a proximal end of the igniter coil;

a connector that is coupled with an end of the coil body toward the proximal end, the connector having an aligning part adapted for centering the center core, the aligning part having a tubular shape for supporting an end of the center core toward the proximal end, the aligning part having an outer peripheral surface that is engaged with an inner peripheral surface of the end of the secondary spool; and a vent groove that is provided to at least one of the outer peripheral surface of the aligning part and the inner peripheral surface of the end of the secondary spool.

8. The ignition coil according to claim 7, wherein the proximal end of the ignition coil is associated with a low-voltage side of the ignition coil.

* * * * *